United States Patent [19]

Hoss et al.

[11] Patent Number: 4,924,543

[45] Date of Patent: May 15, 1990

[54] SHEET WITH ATTACHED COVER AND REMOVABLE PILLOWCASES AND IMPERMEABLE SHEET

[76] Inventors: Margaret A. Hoss; Paul F. Hoss, both of 1456 E. Philadelphia Ave. #6, Ontario, Calif. 91761

[21] Appl. No.: 406,028

[22] Filed: Sep. 11, 1989

[51] Int. Cl.[5] ..... A47G 9/04; A47G 9/02

[52] U.S. Cl. ..... 5/484; 5/421; 5/485; 5/490; 5/496; 5/497; 5/500; 5/502

[58] Field of Search ..... 5/482, 500, 502, 484, 5/485, 490, 496, 497, 498, 421, 503, 508

[56] References Cited

U.S. PATENT DOCUMENTS

| | | | |
|---|---|---|---|
| 1,339,738 | 5/1920 | Callahan et al. | 5/484 |
| 1,343,881 | 6/1920 | Christensen | 5/490 |
| 2,630,588 | 3/1953 | Levin | 5/496 |
| 2,662,234 | 12/1953 | Citron | 5/497 |
| 2,787,794 | 4/1957 | Hughes et al. | 5/496 |
| 2,963,715 | 12/1960 | Young | 5/484 |
| 3,148,388 | 9/1964 | Espersen | 5/485 |
| 3,906,559 | 9/1975 | Bahr | 5/496 |
| 4,014,055 | 3/1977 | Torres | 5/485 |
| 4,045,832 | 9/1977 | Di Forti et al. | 5/496 |
| 4,144,602 | 3/1979 | Fernandes | 5/496 |
| 4,266,308 | 5/1981 | Smatz | 5/497 |
| 4,388,738 | 6/1983 | Wagner | 5/421 |
| 4,574,412 | 3/1986 | Smith | 5/490 |
| 4,815,156 | 3/1989 | Williams | 5/496 |

FOREIGN PATENT DOCUMENTS

| | | | |
|---|---|---|---|
| 2617031 | 12/1988 | France | 5/485 |

*Primary Examiner*—Alexander Grosz
*Attorney, Agent, or Firm*—Leon Gilden

[57] ABSTRACT

A sofabed sheet organization is set forth utilizing a fitted sheet for use in combination particularly with sofabed mattresses wherein the same utilizes elastomeric underlying corners for securement of the fitted sheet to the sofabed with an encircling strap originating from one side wall of the sheet to an enclosed side wall for securement of the sheet to the sofabed, and further including a covering sheet integrally hingedly mounted to an upper or lowermost forward end of the fitted sheet. The organization may alternatively utilize integrally mounted pillow cases and removably mounted adjuncts such as a heating pad, side pockets, or an incontinent sheet for securement interiorly of the fitted sheet.

7 Claims, 4 Drawing Sheets

SHEET WITH ATTACHED COVER AND REMOVABLE PILLOWCASES AND IMPERMEABLE SHEET

BACKGROUND OF THE INVENTION

1. Field of the Invention

The field of invention relates to sheet organizations, and more particularly pertains to a new and improved sofabed sheet organization wherein the same is securable to a sofabed-type mattress to avoid relative movement and mispositioning of the sheet and an associated covering sheet relative to the mattress.

2. Description of the Prior Art

The use of various covering sheet organizations in combination with mattresses and securement thereto is well known in the prior art. The prior art has typically utilized covering sheet organizations for use with conventional mattresses, but the conventional thickness of a sofabed-type mattress promotes mispositioning of the fitted sheet and covering sheet relative to the mattress due to the typical geometric configuration of such mattresses. Examples of the prior art include U.S. Pat. No. 2,630,588 to Levin setting forth the construction of a typical fitted sheet for securement to a mattress wherein the sheet utilizes snap-type fasteners at the corners thereof with an underlying securement strap to overlie a corner of the mattress for securement of the fitted sheet to the mattress.

U.S. Pat. No. 4,045,832 to Diforti, et al., wherein a fitted sheet utilizes hook and loop fastener patches at corners thereof for securement underlying a conventional or waterbed-type mattress.

U.S. Pat. No. 4,144,602 to Fernandes sets forth a flat contour type sheet utilizing hook and loop fasteners formed at flap portions of the sheet for a secure positioning of the sheet relative to the mattress.

U.S. Pat. No. 3,906,559 to Bahr illustrates the use of a covering for a mattress utilizing a pocket at one end to overlie the mattress and strap members at the other end for securement of the organization relative to the mattress.

U.S. Pat. No. 2,787,794 to Hughes sets forth a mattress bed covering utilizing elongate securement portions relative to the seam edges of the covering for securement of the covering relative to an associated mattress.

As such, it may be appreciated that there is a continuing need for a new and improved sofabed sheet organization which addresses both the problems of ease of use and effectiveness in organization, and in this respect, the present invention substantially fulfills this need.

SUMMARY OF THE INVENTION

In view of the foregoing disadvantages inherent in the known types of sheet organizations now present in the prior art, the present invention provides a sofabed sheet organization wherein the same utilizes securement members for attachment of the fitted sheet to an associated mattress with an adjoining covering sheet hingedly mounted to the fitted sheet for securement to the associated mattress. As such, the general purpose of the present invention, which will be described subsequently in greater detail, is to provide a new and improved sofabed sheet organization which has all the advantages of the prior art sheet organizations and none of the disadvantages.

To attain this, the present invention includes a fitted sheet formed with a top surface and a surrounding downwardly depending perimeter skirt with elastomeric bands joining opposed side portions of the skirt to engage a corner portion of an associated mattress. A covering sheet is hingedly mounted to a top surface, or alternatively a lowermost edge of an end portion of the perimeter skirt for overlying the top surface of the fitted sheet. A first strap secured to a lowermost edge of a first side of the perimeter skirt is securable to a second strap secured to an opposed side of the perimeter skirt for encircling the mattress when the first and second straps are secured together. Further embodiments of the instant invention include pillow cases integrally or alternatively selectively securable to upper end surfaces of the top surface of the fitted sheet opposed to the covering sheet hinged edge, and further including selectively securable side pockets, heating pad, or an impermeable incontinent sheet securable relative to the fitted sheet.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sofabed sheet organization which has all the advantages of the prior art sheet organizations and none of the disadvantages.

It is another object of the present invention to provide a new and improved sofabed sheet organization which may be easily and efficiently manufactured and marketed.

It is a further object of the present invention to provide a new and improved sofabed sheet organization which is of a durable and reliable construction.

An even further object of the present invention is to provide a new and improved sofabed sheet organization which is susceptible of a low cost of manufacture with regard to both materials and labor, and which accordingly is then susceptible of low prices of sale to the consuming public, thereby making such sofabed sheet organizations economically available to the buying public.

Still yet another object of the present invention is to provide a new and improved sofabed sheet organization which provides in the apparatuses and methods of the prior art some of the advantages thereof, while simultaneously overcoming some of the disadvantages normally associated therewith.

Still another object of the present invention is to provide a new and improved sofabed sheet organization wherein the same provides enhanced securement means to enable a non-slip relationship between the fitted sheet and covering sheet of the invention relative to an associated mattress.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
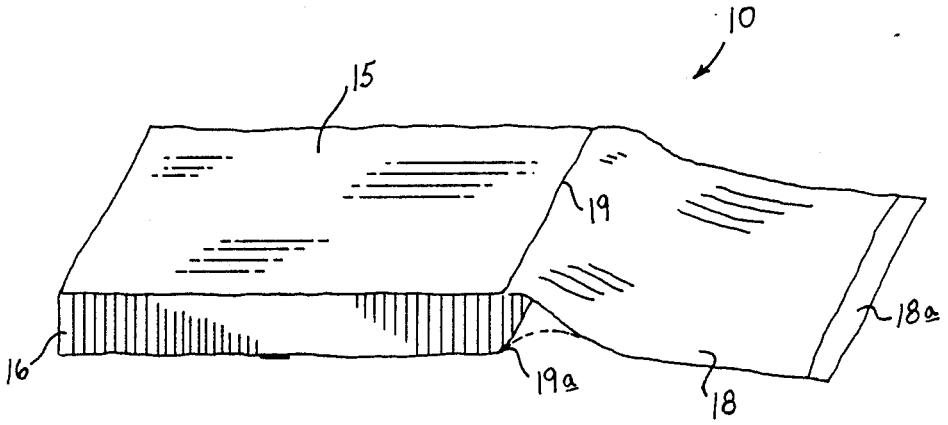
FIG. 1 is an isometric illustration of the instant invention.

With reference now to the drawings, and in particular to FIGS. 1 to 8 thereof, a new and improved sofabed sheet organization embodying the principles and concepts of the present invention and generally designated by the reference numerals 10, 11, 12, 13, and 14 will be described.

Figure 2:
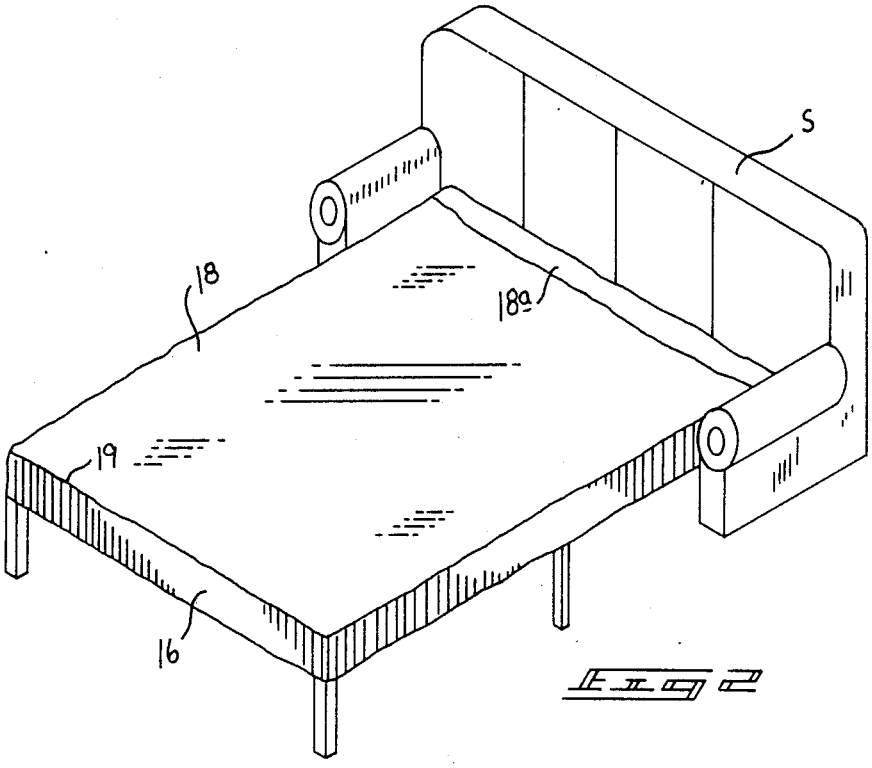
FIG. 2 is an isometric illustration of the instant invention secured to a conventional sofabed.
Figure 3:
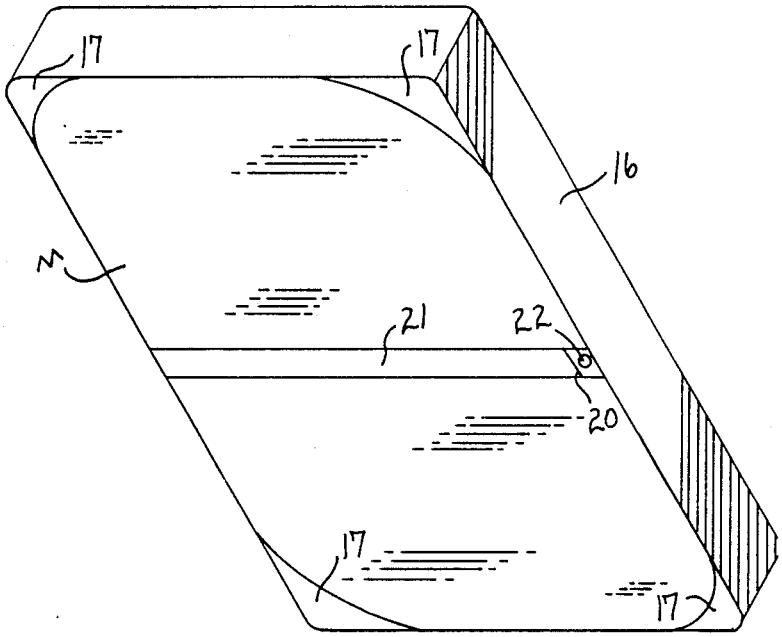
FIG. 3 is an isometric bottom view of the instant invention secured to an associated mattress.
Figure 4:
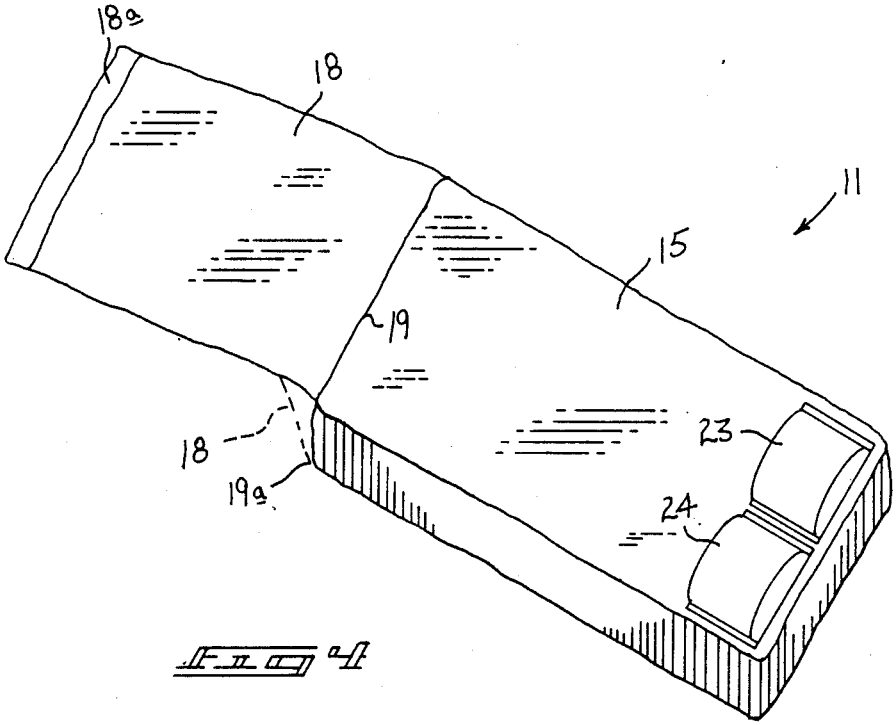
FIG. 4 is an isometric illustration of a second embodiment of the instant invention.

More specifically, the sofabed sheet organization 10 of the instant invention essentially comprises a fitted covering sheet 15 including a downwardly depending perimeter skirt 16 extending downwardly from a perimeter edge of the fitted covering sheet 15, wherein the perimeter skirt 16 includes elastomeric securement corners 17 (see FIG. 3) extending interiorly of and in communication with a lowermost corner edge portion of the skirt 16. A cover sheet 18 is formed with a "free end" 18*a* oversewn about its end for overyling the upper surface of the fitted covering sheet 15 and includes a lower hinge edge 19 sewn in an edge to edge relationship to a lowermost edge of the upper surface of the fitted covering sheet 15 at a hinge 19 or at a lowermost edge of a forward end of the skirt 16, as illustrated in FIG. 1, to produce an alternative lower hinge edge 19*a*. FIG. 3 illustrates a girdle strap comprising a first strap 20 securable to a second strap 21. The straps 20 and 21 are orthogonally disposed relative to lowermost edges of opposing side portions of the skirt 16 and include a clasp fastener 22, or alternatively may utilize a hook and loop securement fastener organization to secure the first and second straps 20 and 21 together. The girdle strap arrangement ensures the positioning and non-sliding relationship of the fitted sheet 15 and perimeter skirt 16 relative the associated mattress "M". The organization, as illustrated in FIG. 2, in association with a conventional sofabed "S". FIG. 4 is illustrative of a second embodiment 11 of the instant invention including a first and second pillow case 23 and 24 respectively fixedly secured, such as utilizing sewing or adhesive fastener means to secure the first and second pillow cases 23 and 24 to a lowermost end of the fitted sheet 15 opposed to the hinge edge 19 securing the covering sheet 18 to the fitted sheet. The fixedly mounted pillow cases enable convenient and expedient replacement of pillows therewithin in use and prevent undesirable sliding of the pillow relative to the associated sofabed sheet organization 11.

Figure 5:
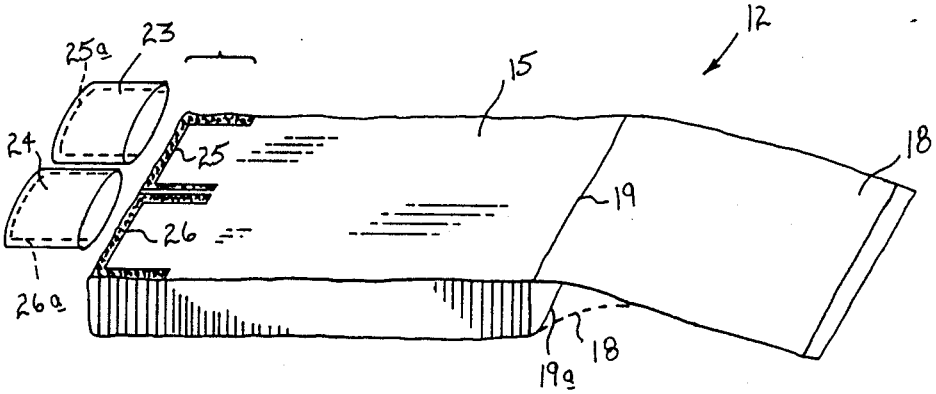
FIG. 5 is an isometric illustration of a third embodiment of the instant invention.

FIG. 5 illustrates a third embodiment 12 of the sofabed sheet organization wherein a first "U" shaped fitted sheet hook and loop fastener strip 25 is positioned adjacent a second "U" shaped fitted sheet hook and loop fastener strip 26 at a lowermost end of the fitted sheet 15 for cooperation with the first and second pillow cases 23 and 24 that each respectively include a "U" shaped pillow case hook and loop fastener strip 25*a* and 26*a* respectively mounted to an underlying surface of each of the first and second pillow cases 23 and 24 to enable removal of the pillows cases 23 and 24 for their independent cleaning relative to the remainder of the sofabed sheet organization 12.

Figure 6:
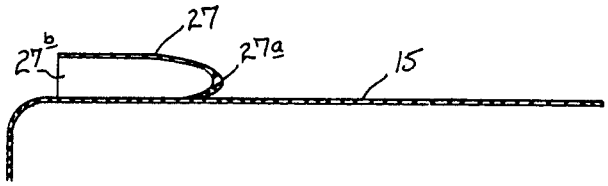
FIG. 6 is an orthographic cross-sectional side view of a modified pillow case secured to the fitted sheet of the instant invention.

FIG. 6 illustrates an alternative pillow case 27 utilizing a closed forward end 27*a* and an open end portion 27*b* for insertion of a pillow therewithin. The pillow case 27 may be utilized in lieu of the pillow cases 23 and 24 in the embodiments, as illustrated in FIGS. 4 and 5 for example. The closed forward end 27*a* provides a varying type of comfort for an individual to enjoy in use.

Figure 7:
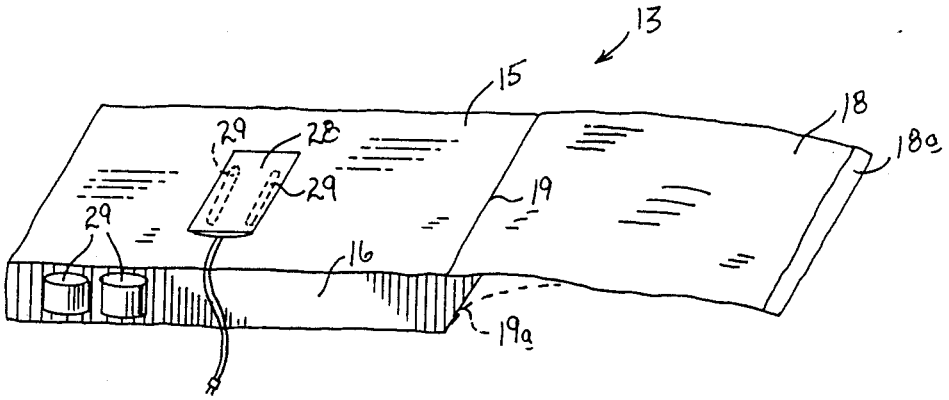
FIG. 7 is an isometric illustration of a fourth embodiment of the instant invention.

FIG. 7 is a fourth embodiment 13 of the sofabed sheet organization utilizing a heating pad 28 provided with heating pad hook and loop fastener strips 29 secured to a lowermost end thereof for association with further hook and loop fastener strips in a complementary positioning on the fitted covering sheet 15. Similarly, removable pockets 29 may be securable to the perimeter skirt 16 for reception of various articles and storage thereof by an individual.

Figure 8:
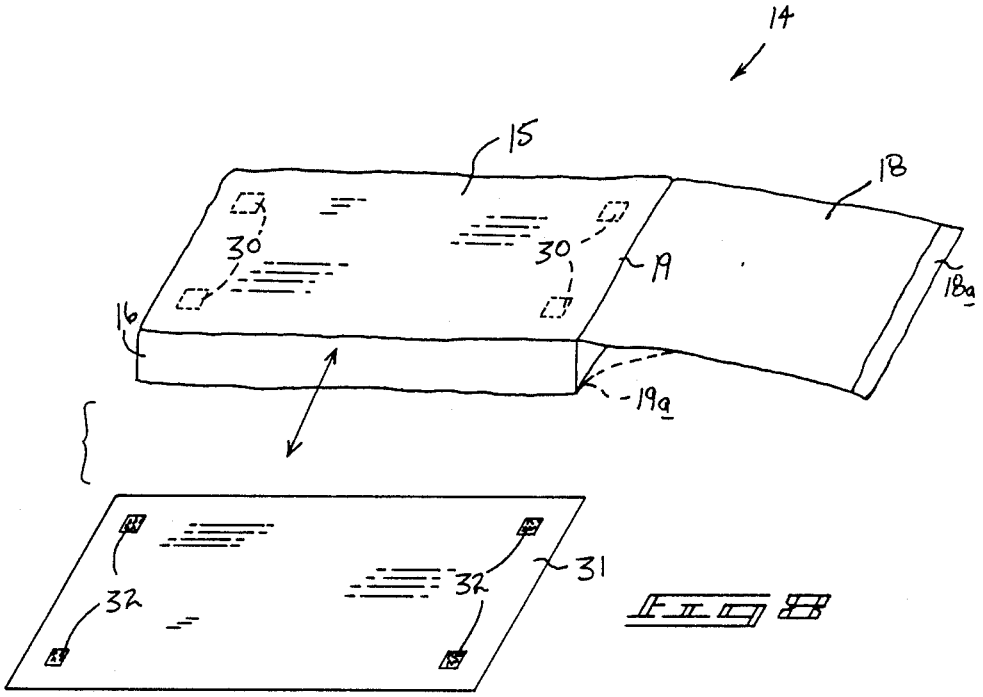
FIG. 8 is an isometric illustration of a fifth embodiment of the instant invention.

FIG. 8 illustrates a fifth embodiment 14 of the sofabed sheet organization wherein an incontinent sheet is securable to an underlying surface of the top surface of the fitted covering sheet 15 and is of a complementary configuration to the top surface of the fitted covering sheet 15 bounded by the perimeter skirt 16. The fitted covering sheet 15 is provided with a series of four covering sheet first hook and loop patches 30 securable to an underlying surface of the fitted covering sheet 15 wherein an impermeable incontinent sheet 31 is provided with a second hook and loop corner patches 32 cooperative with the first hook and loop corner patches 30 to prevent undesirable staining and the like of an underlying mattress when the organization 14 is is secured thereto.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A sofabed sheet organization for securement to a mattress of an associated sofabed, wherein the organization comprises, an elongate fitted covering sheet including a top surface and a bottom surface and including a perimeter skirt coextensively secured to and depending downwardly from a perimeter edge of the fitted sheet and further including a plurality of elastomeric strap members spanning adjacent corners of a lowermost edge of the skirt;

a flexible covering sheet hingedly mounted adjacent to a lower end of the fitted covering sheet;

a first pillow case and a second pillow case, each mounted to the top surface of the fitted covering sheet adjacent to an upper end thereof, each pillow case including respective first and second "U" shaped hook and loop fastener strip cooperative with a respective first and second "U" shaped covering sheet fastener strip, wherein the first and second covering sheet fastener strips are each fixedly mounted to the upper end of the fitted covering sheet on the top surface thereof;

each of the first and second pillow cases including a closed forward end and an open end opposed to the forward end for reception of a pillow within each of the first and second pillow cases;

the bottom surface of the fitted covering sheet further including a first hook and loop fastener patch mounted adjacent each corner of the fitted covering sheet and cooperative with second hook and loop fastener patches, the second hook and loop fastener patches fixedly mounted to an upper surface of a flexible and impermeable sheet member, the sheet member selectively securable to the bottom surface of the fitted covering sheet when the first hook and loop fastener patches are secured to the second hook and loop fastener patches.

2. A sofabed sheet organization as set forth in claim 1 wherein the covering sheet is hingedly mounted to a lowermost edge of the covering sheet.

3. A sofabed sheet organization as set forth in claim 2 wherein the covering sheet is hingedly mounted to a lowermost end of the skirt.

4. A sofabed sheet organization as set forth in claim 3 further including a first strap member and a second strap member, each respectively secured to opposed lowermost edges of opposed sides of the skirt and hingedly mounted medially thereof, and each first and second strap further including a securement member to secure the first and second strap in a surrounding relationship relative to the mattress.

5. A sofabed sheet organization as set forth in claim 1 further including a heating pad including a first and second hook and loop fastener strip secured to an underlying surface of the heating pad cooperative with a second hook and loop fastener strip fixedly mounted to the top surface of the covering sheet cooperative with the first hook and loop fastener strips.

6. A sofabed sheet organization as set forth in claim 5 further including pocket members removably mounted to an exterior surface of the skirt for securement and storage of articles therewithin.

7. A sofabed sheet organization as set forth in claim 1 wherein the impermeable flexible sheet member defines a predetermined configuration equal to that defined by the covering sheet bounded by the perimeter skirt.

* * * * *